US012606962B2

(12) United States Patent
Gunning et al.

(10) Patent No.: US 12,606,962 B2
(45) Date of Patent: Apr. 21, 2026

(54) TRACK RAIL FASTENING SYSTEM AND RAIL CUSHION FOR SAME

(71) Applicant: Progress Rail Services Corporation, Albertville, AL (US)

(72) Inventors: William T. Gunning, Prairie Village, KS (US); Michael B. Steidl, Neunburg vorm Wald (DE); Jose Ricardo Mediavilla Prado, Parkville, MO (US); Edward Constantine, Belton, MO (US)

(73) Assignee: Progress Rail Services Corporation, Albertville, AL (US)

( * ) Notice: Subject to any disclaimer, the term of this patent is extended or adjusted under 35 U.S.C. 154(b) by 803 days.

(21) Appl. No.: 17/948,455

(22) Filed: Sep. 20, 2022

(65) Prior Publication Data

US 2024/0093434 A1 Mar. 21, 2024

(51) Int. Cl.
*E01B 9/68* (2006.01)
*E01B 9/46* (2006.01)

(52) U.S. Cl.
CPC ..... *E01B 9/681* (2013.01); *E01B 9/46* (2013.01)

(58) Field of Classification Search
CPC ..... E01B 9/46; E01B 9/681
See application file for complete search history.

(56) References Cited

U.S. PATENT DOCUMENTS 4,771,944 A 9/1988 Brister et al.
5,335,850 A 8/1994 Igwemezie
6,027,034 A 2/2000 Demming et al.
6,342,287 B1 1/2002 Kaczmarek et al.
6,471,139 B1 10/2002 Bruder et al.
8,905,322 B2 12/2014 Cox et al.
2016/0138226 A1 5/2016 Buda
2016/0194835 A1 7/2016 Miessbacher
2019/0203424 A1* 7/2019 Cox ..... E01B 9/688

FOREIGN PATENT DOCUMENTS

CN 2818538 Y 9/2006
CN 209619761 U 11/2019
EP 0388190 9/1999
PL 220890 B1 4/2009

OTHER PUBLICATIONS

Written Opinion and International Search Report for Int'l. Patent Appln. No. PCT/US2023/073706, mailed Mar. 15, 2024 (13 pgs).

* cited by examiner

*Primary Examiner* — Robert J McCarry, Jr.

(57) ABSTRACT

A track rail fastening system includes a rail cushion positionable laterally between a first fastener assembly and a second fastener assembly. The rail cushion includes a first full-length pad and a second full-length pad, and a pin field formed by a plurality of deformable pins. The first full-length pad and the second full-length pad define a first rail cushioning plane. The deformable pins in the pin field define a second rail cushioning plane. The cushion is deformable between a rest configuration where the cushioning planes are spaced, and a loaded configuration where the cushioning planes are co-planar. Primary, lower load deformable pins are configured to deflect such that under sufficient load both the primary, lower load deformable pins, and secondary, higher load pins engage an underlying substrate.

20 Claims, 3 Drawing Sheets

TRACK RAIL FASTENING SYSTEM AND RAIL CUSHION FOR SAME

TECHNICAL FIELD

The present disclosure relates generally to a track rail fastening system, and more particularly to a rail cushion having dynamic stiffness and using deformable pins deflectable under load to provide multiple different rail cushioning planes.

BACKGROUND

Track rail fastening systems are used globally for attaching track rails for freight, passenger, and commuter trains to an underlying substrate. Track rail fasteners can range from simple metal plates attaching rails to wooden ties using spikes, to highly engineered direct fixation fasteners formed by an assembly of metallic and non-metallic components.

Concerns relating to transmission of loads and vibrations between rail equipment and substrates have been known for well over a century. Various strategies have been proposed over the years to absorb or otherwise mitigate loads and vibrations for the purpose of reducing noise and extending service life of rail machinery and parts of the rail line itself.

It is common in some rail-fastening strategies to employ a deformable cushion underneath a section of track rail that can squish and rebound as rail equipment passes over the track rails. It is desirable in some instances to provide cushioning that can vary dependent upon the size of the load, namely, weight of the rail equipment traveling on supported parts of the track rails at any given moment. One known track rail pad is set forth in U.S. Pat. No. 4,771,944 to Brister et al. While the rail pad in Brister et al. appears to provide some desirable functionality for certain applications, the art provides ample room for improvements and development of alternative strategies.

SUMMARY

In one aspect, a track rail fastening system includes a first fastener assembly having a fastener, an anchor bolt extending through the fastener, and a rail clip. The fastening system further includes a second fastener assembly having a fastener, an anchor bolt extending through the fastener, and a rail clip. The fastening system further includes a rail cushion positionable laterally between the first fastener assembly and the second fastener assembly, and including a first vertical side, and a second vertical side. The rail cushion further includes a center section, a first full-length pad, and a second full-length pad, together forming, upon the first vertical side, a continuous planar face. The first full-length pad and the second full-length pad include, upon the second vertical side, a first lateral face and a second lateral face, respectively, defining a first rail cushioning plane. The center section includes, upon the first second vertical side, a pin field formed by a plurality of deformable pins confined in distribution between the first full-length pad and the second full-length pad and including respective pin end surfaces defining a second rail cushioning plane spaced vertically outward of the first rail cushioning plane.

In another aspect, a rail cushion for positioning laterally between fastener assemblies in a track rail fastening system includes a one-piece cushion body including a first vertical side, a second vertical side, and a center section, a first full-length pad, and a second full-length pad, together forming, upon the first vertical side, a continuous planar face. The first full-length pad and the second full-length pad include, upon the second vertical side, a first lateral face and a second lateral face, respectively, defining a first rail cushioning plane. The center section includes, upon the second vertical side, a pin field formed by a plurality of deformable pins confined in distribution between the first full-length pad and the second full-length pad and including respective pin end surfaces defining a second rail cushioning plane spaced vertically outward of the first rail cushioning plane.

In still another aspect, a rail cushion includes a one-piece cushion body having a first pad and a second pad including a first lateral face and a second lateral face, respectively, each extending in a fore-aft direction from a back pad edge to a front pad edge, and laterally from an inboard edge to an outboard edge of the respective first pad or second pad. A pin recess extends fore-aft from the back pad edge to the front pad edge and laterally between the inboard edges. The cushion body further includes a pin field within the pin recess. The first lateral face and the second lateral face define a first rail cushioning plane. The pin field is formed by a lower load pin set defining a second rail cushioning plane, and a higher load pin set defining a third rail cushioning plane. The one-piece cushion body is deformable between a rest configuration where the first, second, and third rail cushioning planes are spaced, and a loaded configuration where the first, second, and third rail cushioning planes are co-planar.

DETAILED DESCRIPTION

Figure 1:
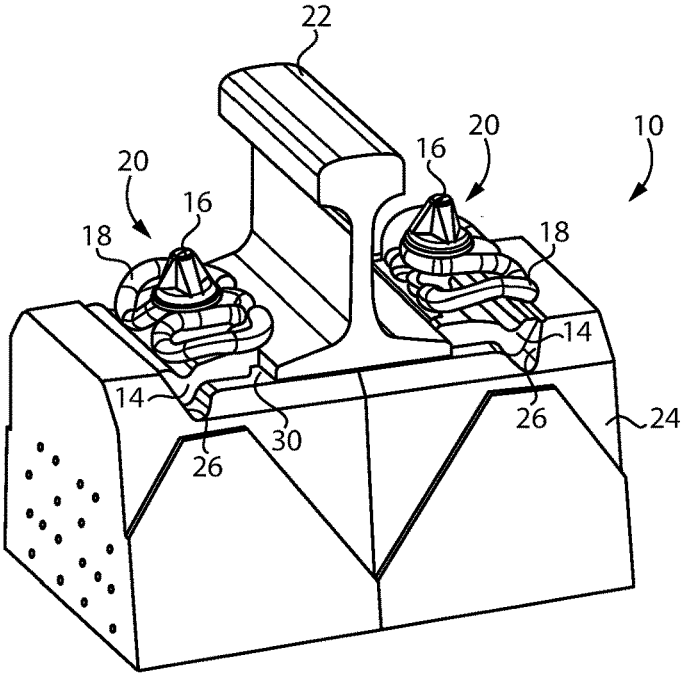
FIG. 1 is an isometric view of a track rail fastening system, according to one embodiment.

Referring to FIG. 1, there is shown a track rail fastening system 10, according to one embodiment. Fastening system 10 includes a first fastener assembly 12 having a fastener 14, an anchor bolt 16 extending through fastener 14, and a rail clip 18. Fastening system 10 also includes a second fastener assembly 20 having a fastener 14, an anchor bolt 16 extending through fastener 14, and a rail clip 18. In fastener assembly 12 on the left side of the drawing in FIG. 1, rail clip 18 is shown as it might appear held fast between anchor bolt 16 and fastener 14 to clamp a section of track rail 22 upon a substrate 24. Second fastener assembly 20 is shown as it might appear where the respective rail clip 18 is positioned to be engaged between the respective anchor bolt 16 and fastener 14 but not yet positioned in place to clamp track rail 22. Fasteners 14 may include so-called cradle fasteners or cradles received in a groove 26 cast-in within substrate 24. Substrate 24 may include a concrete tie in some embodiments. The present disclosure is applicable without limitation to the type of fastening apparatus used to attach a track rail to a substrate. A rail cushion 30 is sandwiched between track rail 22 and underlying substrate 24, having features and functionality further discussed herein.

Figure 2:
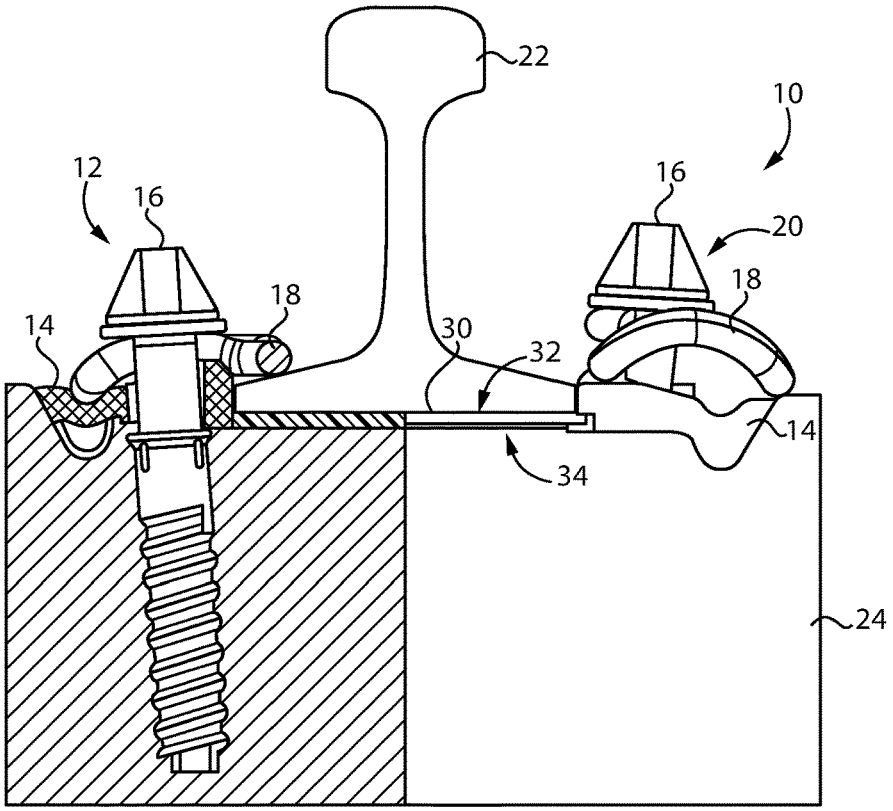
FIG. 2 is a partially sectioned end view of the fastening system of FIG. 1.

Referring also now to FIG. 2, there is shown a partially sectioned view of fastening system 10 where the positioning of rail cushion 30 between track rail 22 and substrate 24 is further apparent. Rail cushion 30 is positionable laterally between first fastener assembly 12 and second fastener assembly 20, and includes a first vertical side 32, and a second vertical side 34. Lateral directions are to be understood herein as left-to-right or right-to-left in reference to the FIG. 2 illustration. Vertical directions are toward the top of the page or toward the bottom of the page in reference to FIG. 2. A fore-aft direction extends into and out of the page in FIG. 2. During service, rail equipment having varying weights can travel upon track rail 22 and a counterpart, similarly configured parallel track rail not illustrated. Railcars can have varying weights depending upon construction, relative loading level, and the weight of cargo transported. Passenger cars can likewise vary in weight based upon car size and design as well as passenger load. Locomotives may also vary in weight and may represent the heaviest loads carried upon a given rail line. It has been observed that having a plurality of fixed levels of cushion deformation can enable rail cushion 30 to compress up to a first relative extent in response to a first range of vertical loads, up to a second relative extent in response to a second, higher range of vertical loads, and in some instances up to a third relative extent in response to loads that are heavier still. As will be further apparent from the following description, cushion 30 is uniquely configured via dynamic vertical stiffness to perform in this general manner, resiliently compressing at stepped load levels, and resiliently rebounding when the loads are varied or removed.

Figure 3:
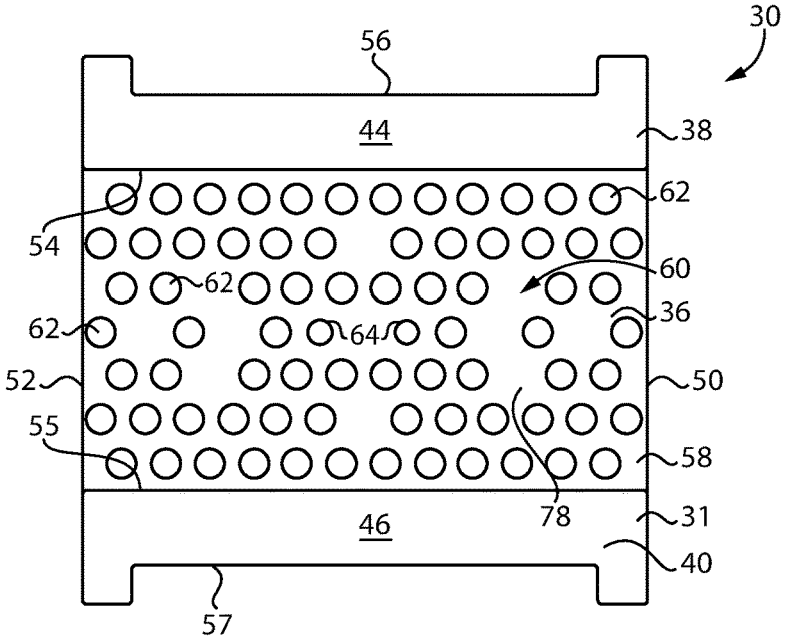
FIG. 3 is an elevational view of a rail cushion, according to one embodiment.
Figure 5:
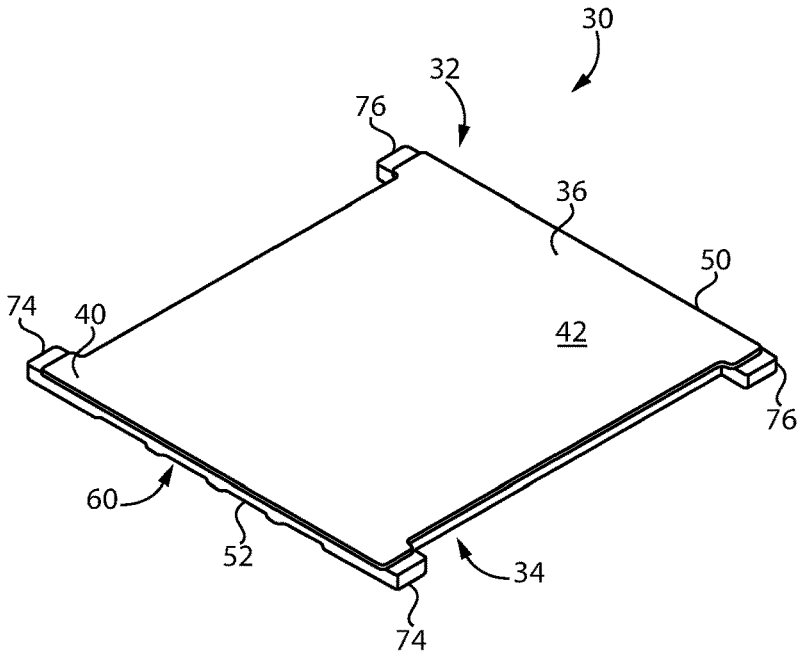
FIG. 5 is a sectioned view of a rail cushion as in FIG. 3 and FIG. 4.
Figure 4:
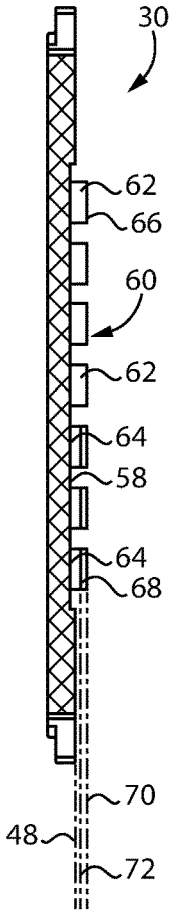
FIG. 4 is a diagrammatic view of a rail cushion as in FIG. 3.

Referring also now to FIGS. 3-5, rail cushion 30 includes a one-piece cushion body 31 that is formed of a suitable non-metallic material such as an elastomeric material, a rubber material, or a rubber-like non-metallic material. Rail cushion 30 and cushion body 31 are terms used, at times, interchangeably herein. Rail cushion 30 further includes a center section 36, a first full-length pad 38, and a second full-length pad 40. First full-length pad 38 and second full-length pad 40 together form, upon first vertical side 32, a continuous planar face 42. When installed for service in fastening system 10, continuous planar face 42 may be contacted by track rail 22 with second vertical side 34 of rail cushion 30 contacting underlying substrate 24. The present disclosure is not thereby limited, however, and in some instances planar face 42 might face and contact an underlying substrate or an intervening material such as another pad or plate.

First full-length pad 38 and second full-length pad 40 include, upon second vertical side 32, a first lateral face 44 and a second lateral face 46, respectively, defining a first rail cushioning plane 48. First lateral face 44 and second lateral face 46 extend in a fore-aft direction from a back pad edge 50 to a front pad edge 52, and laterally from an inboard edge 54, 55 to an outboard edge 56, 57 of the respective first full-length pad 38 or second full-length pad 40.

A pin recess 58 extends fore-aft from back pad edge 50 to front pad edge 52 and laterally between inboard edges 54 and 55. Center section 36 of cushion 30 further includes a pin field 60 within pin recess 58, upon second vertical side 32. Pin field 60 is formed by a plurality of deformable pins 62, 64 confined in distribution between first full-length pad 38 and second full-length pad 40. Deformable pins 62 and 64 include respective pin end surfaces 66 and 68. At least some of pin end surfaces 66 and 68 define a second rail cushioning plane 70 spaced vertically outward of first rail cushioning plane 48. Some of pins 62 may form a lower load pin set that defines second rail cushioning plane 70, and a higher load pin set defining a third rail cushioning plane 72. The lower load pin set may include pins that are configured to contact and engage substrate 24 when a lower load, or no load, is applied to rail cushion 30 in a vertical direction. The higher load pin set may include pins that are configured to contact and engage substrate 24 when a higher load is applied to rail cushion 30 in a vertical direction. In this example, the lower load pin set and higher load pin set will thus both contact substrate 24 when a higher load is applied. In some variations, all of the pins forming pin field 60 may contact substrate 24 even at lower loads, with the load principally reacted by a lower load pin set configured to deform under increasing load to result in full engagement of the higher load pin set. Further functionality of the deformable pins forming pin field 60 is further discussed herein.

Rail cushion 30 may be deformable between a rest or unloaded configuration, apart from a clamping load of track rail 22, where first, second, and third rail cushioning planes 48, 70, and 72 are spaced apart vertically, and a loaded configuration where first, second, and third rail cushioning planes 48, 70, and 72 are co-planar. In an implementation the loaded configuration may be a fully loaded configuration, and rail cushion 30 is further deformable from either the rest configuration or the fully loaded configuration to a medium loaded configuration where second and third rail cushioning planes 70 and 72 are co-planar and spaced from first rail cushioning plane 48.

Deformation amongst the several loaded configurations can occur based upon different behavior and performance and geometry of deformable pins 62 and 64. Deformable pins 62 and 64 may be non-uniform with respect to at least one of size, length, or distribution within pin field 60. As can be seen from the drawings, deformable pins 62 and 64 may all be cylindrical. In the FIG. 3 illustration it can be seen that deformable pins 62 are larger pins and define larger cylinders and deformable pins 64 are smaller pins and define smaller cylinders. As shown in FIG. 5, it can be seen that deformable pins 62 may stand taller than deformable pins 64. Thus, when positioned for service, cushion 30 may be seated upon substrate 24 upon pin end surfaces 66. When a relatively light load is applied deformable pins 62 may maintain their support of the load, resiliently deforming in response to variations in load in a lower load range. When an increased load is applied, deformable pins 62 can squish down such that cushion 30 is then seated upon pin end surfaces 66 and also pin end surfaces 68. When a still greater load is applied, cushion 30 can squish down further still to be seated upon pin end surfaces 66, 68 and also upon first full-length pad 38 and second full-length pad 40. As noted above, deformable pins 62 and 64 may include larger pins and smaller pins. Larger and smaller may refer to a width of the respective pins, and typically also to a height of the respective pins in pin field 60. Embodiments are nevertheless contemplated where all pins are of the same width but different heights, where all pins have the same height but different widths, and still other variations. In a practical implementation pins 62 may be at least one of larger in size or larger in number than pins 64.

It can also be seen from FIG. 3 that a space 78 extends among deformable pins 62 and 64 in pin field 60. A relative number and and/or density of pins relative to a volume of space 78 can be employed to selectively position material in a vertical load path and thereby obtain the discrete loading levels and configurations discussed herein.

Figure 6:
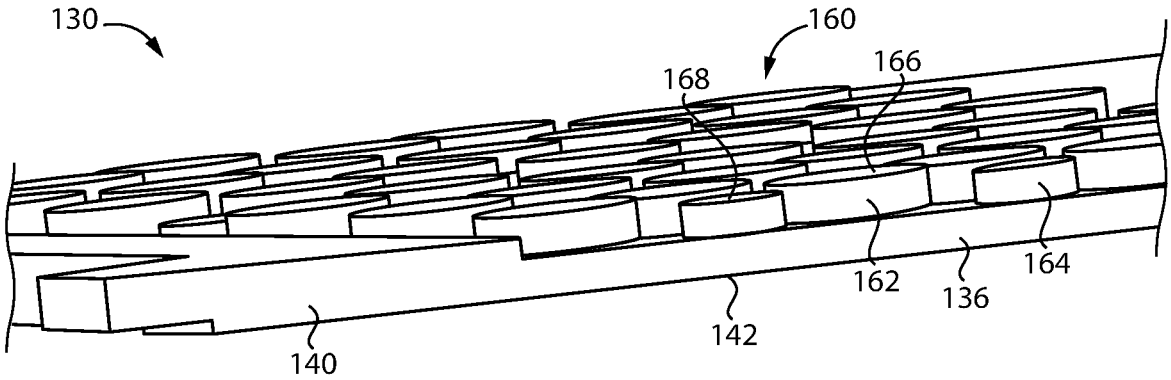
FIG. 6 is a diagrammatic view of a portion of a rail cushion, according to another embodiment.

Referring now to FIG. 6, there is shown a cushion 130 according to another embodiment, and including a center section 136, a first full-length pad 138 having a first lateral face 144, and a second full-length pad 140 having a second lateral face 146. A pin field 160 formed by deformable pins 162 and 164 extends laterally between first full-length pad 138 and second full-length pad 140, and fore-aft between front and back pad edges. Each of first full-length pad 138 and second full-length pad 140 may include an inboard edge 154 longitudinally contoured with part-cylindrical pin-like surfaces. It can also be seen from FIG. 7 that deformable pins 162 include larger diameter pins and deformable pins 164 include smaller diameter pins. In the illustrated embodiment deformable pins 164 are shorter pins, and deformable pins 166 are taller pins. A vertical height of deformable pins 162 may be such that pin end surfaces 166 are positioned vertically higher than exposed faces of first full-length pad 138 and second full-length pad 140. Deformable pins 164 may be of a height such that pin end surfaces 168 are lower than pin end surfaces 166, but higher than exposed lateral faces 144 and 146. First full-length pad 138 and second full-length pad 140 may thus define a first rail cushioning plane, pin end surfaces 166 may define a second rail cushioning plane vertically outward of the first rail cushioning plane, and pin end surfaces 168 may define a third rail cushioning plane vertically between the first rail cushioning plane and the second rail cushioning plane. The terms "first," "second," and "third" are used herein merely for descriptive convenience and are not intended to require any particular ordering or sequence.

It will thus be appreciated that when placed in service cushion 130 might rest upon pin end surfaces 166 so long as a relatively light vertical load is applied. When squished down under an increased load, cushion 130 will rest also upon pin end surfaces 168, and when squished down under a still higher load first and second full-length pads 138 and 140 will be engaged.

Figure 7:
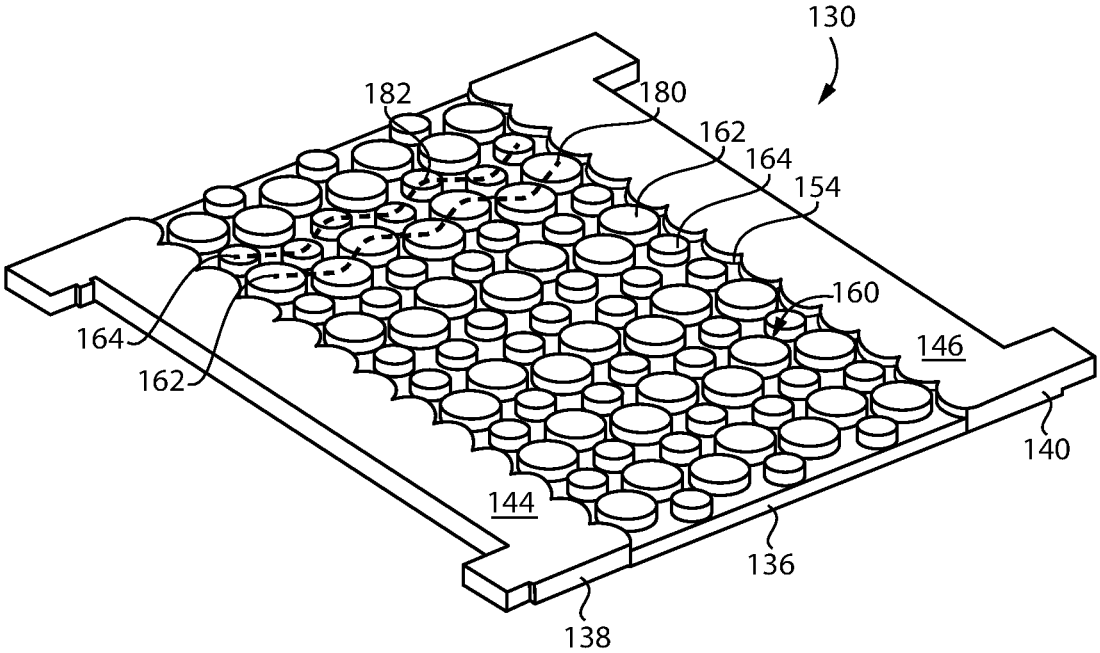
FIG. 7 is a diagrammatic view of a rail cushion as in FIG. 6.

Still further illustrated in FIG. 7 is a staggered arrangement of deformable pins 162 and a staggered arrangement of deformable pins 164. An approximate staggered centerline 180 defined by deformable pins 162 is shown generally extending parallel to a staggered line 182 defined by deformable pins 164. It can also be noted that the staggered arrangements of pins 162 is in an alternating arrangement fore-aft with pins 164.

INDUSTRIAL APPLICABILITY

Referring to the drawings generally. it will be recalled that different relative extents of deformation of cushions according to the present disclosure can be observed in response to different load levels. There are many different configurations contemplated for deformable pins, including variations as to size, height, number, pin density, and combinations of these within the respective pin field. While in the illustrated embodiments larger pins are used as primary pins that contact a substrate when a cushion is relatively lightly loaded, and deflect to enable engagement of smaller secondary pins for larger loads, in other embodiments smaller pins could initially engage a substrate and deflect under load to enable engagement of larger pins. Deflecting of the pins can include vertical squeezing as well as lateral or fore-aft deflection depending upon design of the rail cushion. Among the various embodiments, during lower load operational conditions only some pins will engage, providing desired elasticity for a smooth and reasonably quiet ride. When heavier loads are applied, additional pins will engage whilst still providing elasticity, and when still heavier loads are applied all of the pins will deform causing the full-length pads to become engaged.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A track rail fastening system comprising:

a first fastener assembly including a fastener, an anchor bolt extending through the fastener, and a rail clip;

a second fastener assembly including a fastener, an anchor bolt extending through the fastener, and a rail clip;

a rail cushion positionable laterally between the first fastener assembly and the second fastener assembly, and including a first vertical side, and a second vertical side;

the rail cushion further including a center section, a first full-length pad, and a second full-length pad, together forming, upon the first vertical side, a continuous planar face;

the first full-length pad and the second full-length pad including, upon the second vertical side, a first full-length lateral face and a second full-length lateral face, respectively, defining a first rail cushioning plane; and the center section including, upon the first second vertical side, a pin field formed by a plurality of deformable pins confined in distribution between the first full-length pad and the second full-length pad, such that a lateral extent of the pin field is limited to between the first full-length lateral face and the second full-length lateral face, and each of the plurality of deformable pins including respective pin end surfaces defining a second rail cushioning plane spaced vertically outward of the first rail cushioning plane.

2. The fastening system of claim 1 wherein the plurality of deformable pins are non-uniform with respect to at least one of size, length, or distribution within the pin field.

3. The fastening system of claim 2 wherein the deformable pins are cylindrical.

4. The fastening system of claim 2 wherein the plurality of deformable pins includes larger pins and smaller pins.

5. The fastening system of claim 4 wherein at least one of the larger pins or the smaller pins are in a respective staggered arrangement.

6. The fastening system of claim 4 wherein the second rail cushioning plane is defined by the pin end surfaces of the larger pins.

7. The fastening system of claim 6 wherein the pin surfaces of the smaller pins define a third rail cushioning plane spaced vertically from the first rail cushioning plane and the second rail cushioning plane.

8. The fastening system of claim 7 wherein the third rail cushioning plane is vertically between the first rail cushioning plane and the second rail cushioning plane.

9. A rail cushion for positioning laterally between fastener assemblies in a track rail fastening system comprising:

a one-piece cushion body including a first vertical side, a second vertical side, and a center section, a first full-length pad, and a second full-length pad, together forming, upon the first vertical side, a continuous planar face;

the first full-length pad and the second full-length pad including, upon the second vertical side, a first full-length lateral face and a second full-length lateral face, respectively, defining a first rail cushioning plane; and the center section including, upon the second vertical side, a pin field formed by a plurality of deformable pins confined in distribution between the first full-length pad and the second full-length pad, such that a lateral extent of the pin field is limited to between the first full-length lateral face and the second full-length lateral face, and the plurality of deformable pins including respective pin end surfaces defining a second rail cushioning plane spaced vertically outward of the first rail cushioning plane.

10. The rail cushion of claim 9 wherein the plurality of deformable pins includes larger pins and smaller pins.

11. The rail cushion of claim 10 wherein the second rail cushioning plane is defined by the pin end surfaces of the larger pins.

12. The rail cushion of claim 11 wherein the pin end surfaces of the smaller pins define a third rail cushioning plane.

13. The rail cushion of claim 12 wherein the third rail cushioning plane is vertically between the first rail cushioning plane and the second rail cushioning plane.

14. The rail cushion of claim 12 wherein the plurality of deformable pins are cylindrical, and each of the larger pins and the smaller pins is in a respective staggered arrangement.

15. The rail cushion of claim 14 wherein the staggered arrangement of the larger pins alternates with the staggered arrangement of the smaller pins.

16. The rail cushion of claim 14 wherein the one-piece cushion body includes forward ears and back ears, each extending laterally from one of the first full-length pad or the second full-length pad.

17. A rail cushion comprising:

a one-piece cushion body including a first pad and a second pad including a first lateral face and a second lateral face, respectively, each extending in a fore-aft direction from a back pad edge to a front pad edge, and laterally from an inboard edge to an outboard edge of the respective first pad or second pad;

a pin recess extends fore-aft from the back pad edge to the front pad edge and laterally between the inboard edges, and the cushion body further includes a pin field within the pin recess;

the first lateral face and the second lateral face defining a first rail cushioning plane;

the pin field is formed by a lower load pin set defining a second rail cushioning plane, and a higher load pin set defining a third rail cushioning plane; and the one-piece cushion body is deformable between a rest configuration where the first, second, and third rail cushioning planes are spaced, and a loaded configuration where the first, second, and third rail cushioning planes are coplanar.

18. The rail cushion of claim 17 wherein the loaded configuration is a fully loaded configuration, and the one-piece cushion body is further deformable to a medium loaded configuration where the second and third rail cushioning planes are coplanar and spaced from the first rail cushioning plane.

19. The rail cushion of claim 18 wherein the higher load pin set is smaller in size than the lower load pin set, and wherein the higher load pin set and the lower load pin set each include cylindrical pins.

20. The rail cushion of claim 17 wherein the lower load pin set is configured to engage an underlying substrate during a lower load condition, and to deflect during a higher load condition, such that the higher load pins engage the underlying substrate.

* * * * *